US012123694B2

(12) United States Patent
Orsat

(10) Patent No.: US 12,123,694 B2
(45) Date of Patent: Oct. 22, 2024

(54) COMBUSTIBLE CARTRIDGE CASE FOR AMMUNITION

(71) Applicant: NEXTER MUNITIONS, Versailles (FR)

(72) Inventor: Guillaume Orsat, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 18/023,942

(22) PCT Filed: Aug. 26, 2021

(86) PCT No.: PCT/IB2021/057831

§ 371 (c)(1),
(2) Date: Feb. 28, 2023

(87) PCT Pub. No.: WO2022/049465

PCT Pub. Date: Mar. 10, 2022

(65) Prior Publication Data

US 2024/0027174 A1 Jan. 25, 2024

(30) Foreign Application Priority Data

Sep. 1, 2020 (FR) ..... 2008811

(51) Int. Cl.
*F42B 5/18* (2006.01)

(52) U.S. Cl.
CPC ..... *F42B 5/181* (2013.01)

(58) Field of Classification Search
CPC ..... F42B 5/181; F42B 5/18; F42B 5/182
USPC ..... 102/431, 432, 433
See application file for complete search history.

(56) References Cited

U.S. PATENT DOCUMENTS

| | | | | |
|---|---|---|---|---|
| 3,577,922 A | 5/1971 | Zehfeld et al. | | |
| 3,955,506 A | 5/1976 | Luther et al. | | |
| 4,928,598 A * | 5/1990 | Sabranski | F42B 5/181 | 102/431 |
| 6,450,099 B1 * | 9/2002 | Desgland | F42B 5/285 | 102/431 |

(Continued)

FOREIGN PATENT DOCUMENTS

| | | |
|---|---|---|
| DE | 198 49 824 A1 | 5/2000 |
| EP | 0 248 978 A2 | 12/1987 |

(Continued)

OTHER PUBLICATIONS

Jan. 7, 2022 Search Report issued in International Patent Application No. PCT/IB2021/057831.

(Continued)

*Primary Examiner* — John Cooper
(74) *Attorney, Agent, or Firm* — Oliff PLC

(57) ABSTRACT

The invention relates to a combustible cartridge case (1) for ammunition, comprising a cylindrical envelope (2) intended to contain a propellant charge and to receive a projectile at a front end (AV). The cartridge case comprises, at a rear end (AR), a bottom (3) that is integral with the cylindrical envelope (2) and is intended to be positioned in a base. The cartridge case is characterised in that the bottom (3) comprises a combustible central ring (5) that is connected to a peripheral cup (4) by at least two combustible radial arms (6) delimiting openings (7).

7 Claims, 3 Drawing Sheets

(56) References Cited

U.S. PATENT DOCUMENTS

| | | | | |
|---|---|---|---|---|
| 6,523,476 | B1 * | 2/2003 | Riess | F42B 5/18 102/431 |
| 6,708,621 | B1 * | 3/2004 | Forichon-Chaumet | F42C 19/0834 102/470 |
| 2020/0378733 | A1 * | 12/2020 | Orsat | F42B 5/08 |
| 2022/0099417 | A1 * | 3/2022 | Calvete | F41C 9/08 |

FOREIGN PATENT DOCUMENTS

| | | | |
|---|---|---|---|
| EP | 0 307 307 | A1 | 3/1989 |
| EP | 1 092 939 | A1 | 4/2001 |
| FR | 1.499.078 | A | 10/1967 |
| FR | 2.215.603 | A1 | 8/1974 |

OTHER PUBLICATIONS

Jan. 7, 2022 Written Opinion of the International Searching Authority issued in International Patent Application No. PCT/IB2021/057831.

May 10, 2021 Search Report and Written Opinion issued in French Patent Application No. 2008811.

* cited by examiner

[Fig. 1]
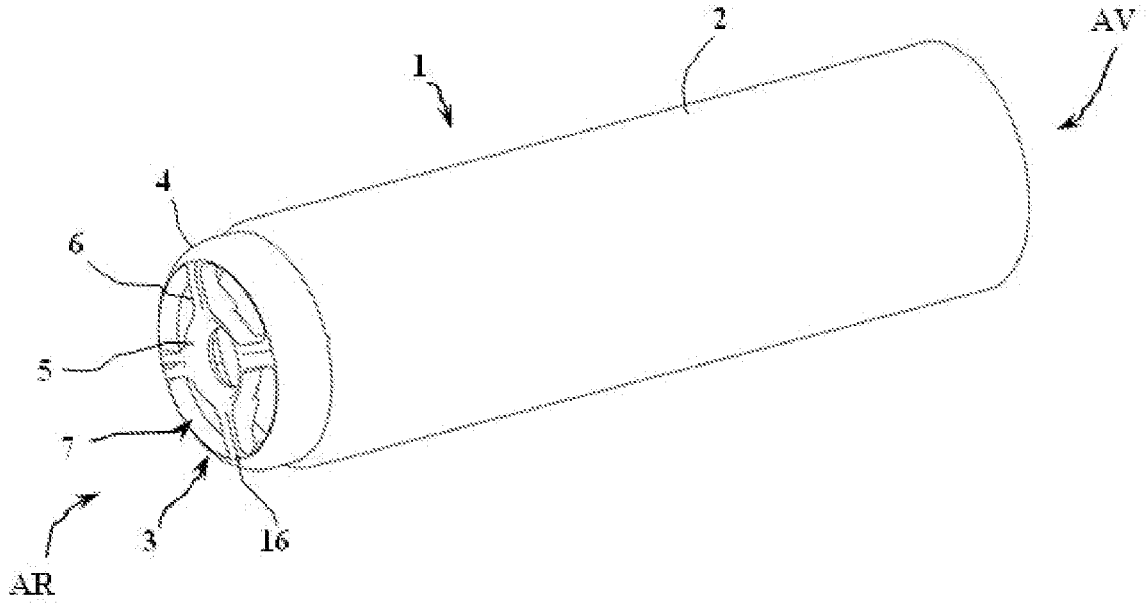
[Fig. 2]
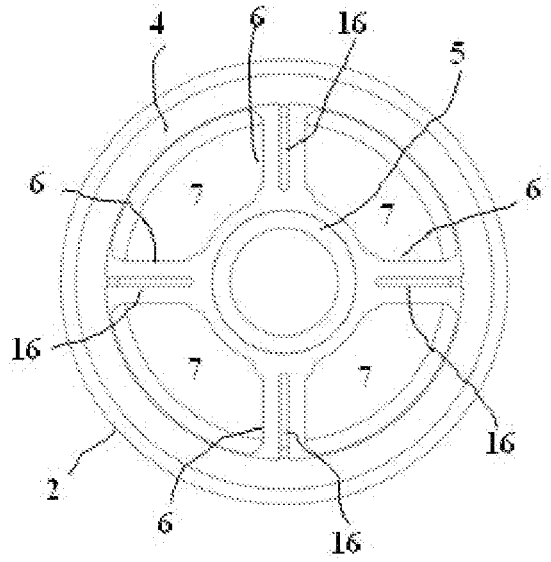

[Fig. 3]
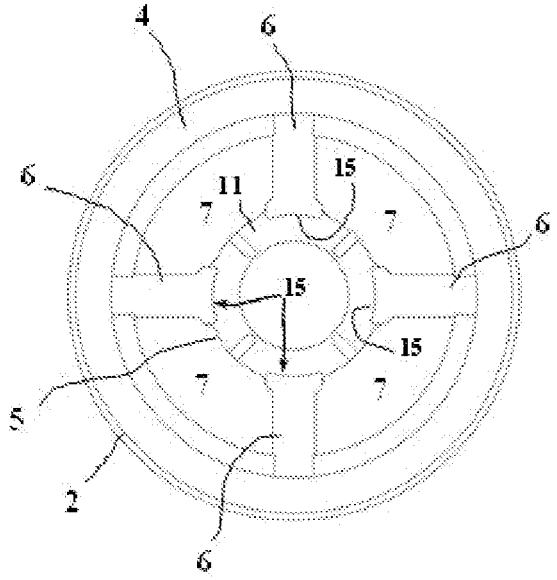

[Fig. 4]
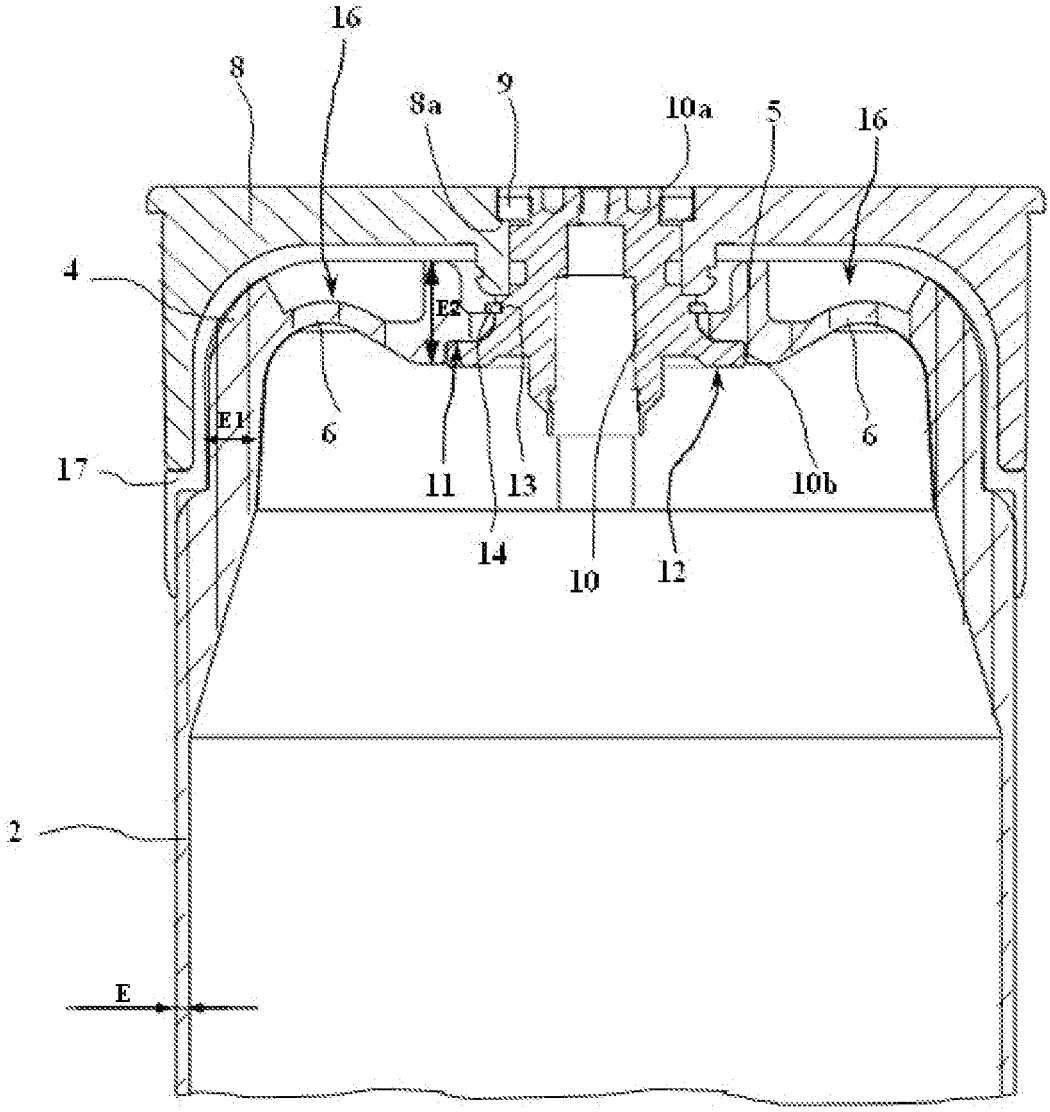

COMBUSTIBLE CARTRIDGE CASE FOR AMMUNITION

The technical field of the invention is that of combustible cartridge cases for ammunition, and in particular for large-caliber ammunition (larger than 45 mm).

Conventionally, large-caliber fixed ammunition is made in the form of combustible cartridge cases bearing a projectile at a forward end and a base at a rear end.

The base receives an igniter that makes it possible to initiate a propellant charge contained in the cartridge case. The projectile is fixed to the cartridge case, for example by a weakened connection ring (as described in patent EP0307307).

A base is fixed to the cartridge case, most often by means of an interface cup made from plastic, as described by patent EP1092939.

Such ammunition with a combustible cartridge case makes it possible to reduce combustion and firing residues, which are then limited to the base, which is ejected from the chamber of the weapon and stored in the turret of the vehicle.

Also known from patent EP1092939 is ammunition with a combustible cartridge case, the combustible cartridge of which includes a bottom that is also combustible and that is housed in the base, and which bears a support tube for supporting the igniter.

Such a support tube, like the connection cup, remains a plastic part that forms firing residue that, most often, separates from the base and remains in the chamber of the weapon, at the risk of causing firing incidents.

The invention aims to propose a combustible cartridge case that allows the proportion of combustion and firing residues to be reduced while making the connection of the base and the cartridge case more reliable.

Thus, the invention relates to a combustible cartridge case for ammunition, the cartridge case comprising a cylindrical enclosure intended to contain a propellant charge and to receive a projectile at a forward end, the cartridge case including, at a rear end, a bottom made in a single piece with the cylindrical enclosure and which is intended to be positioned in a base, the cartridge case being characterized in that the bottom includes a combustible central ring that is connected to a peripheral cup by at least two combustible radial arms delimiting openings.

According to one particular embodiment, the central ring may include an annular bearing surface intended to receive an igniter means.

Advantageously, the annular bearing surface may be delimited by at least one partially cylindrical zone intended to cooperate with a flat of the igniter means and intended to form a rotational stop means for the igniter means.

According to one particular embodiment, each connecting arm may have a connection profile that is reinforced both at the central ring and at the peripheral cup.

Advantageously, each arm may include a radial slot reducing its thickness and extending from the central ring to the peripheral cup.

The bottom may include at least one structural reinforcing material.

The reinforcing material may for example comprise synthetic or mineral fibers distributed in the combustible material of the cartridge case.

The reinforcing material may comprise at least one perforated insert, such as a canvas or mesh, embedded in the combustible material of the cartridge case.

The invention will be better understood upon reading the following description of one particular embodiment, which description is done in reference to the appended drawings, in which:

FIG. 1 is a rear perspective view of a combustible cartridge case according to the invention;

FIG. 2 is a view of the bottom of the cartridge case, seen from outside the cartridge case;

FIG. 3 is a view of the bottom of the cartridge case, seen from inside the cartridge case;

FIG. 4 is a partial longitudinal sectional view of the cartridge case bearing a base and an igniter means.

In reference to FIGS. 1 to 3, a combustible cartridge case 1 according to the invention comprises a cylindrical enclosure 2 that is intended to contain a propellant charge (not shown) and to receive a projectile (not shown) at a forward end AV.

This cartridge case 1 includes, at a rear end AR, a bottom 3 that is made in a single piece with the cylindrical enclosure 2 and that is intended to be positioned in a base (not shown).

As shown in the figures, the bottom 3 includes a peripheral cup 4 that has a diameter smaller than the diameter of the enclosure 2 and a combustible central ring 5 that is connected to the peripheral cup 4 by at least two radial arms 6 delimiting openings 7. The openings 7 are intended to allow the cartridge case to be loaded with a propellant powder before the base is fixed.

The entirety of the bottom 3, like the enclosure 2, is made from a combustible material, for example from a mixture of Kraft paper pulp and nitrocellulose. This cartridge case may be painted.

Thus, the cartridge case 1 according to the invention is in a single piece and entirely combustible, and it is no longer necessary to fix a plastic bottom (or cup) on the cylindrical enclosure 2 to connect it to the base.

FIG. 4 shows the mounting of a base 8 on the bottom 3 of the cartridge case 1.

The base 8 is fixed by a nut 9 screwed on an igniter means 10 that is metallic (for example made from brass).

Fixing a base on an igniter means using a nut is described by patent EP1092939.

Thus, the igniter means 10 includes a threaded rear part 10*a* that receives the nut 9. The latter bears against a counterbore 8*a* of the base 8.

A lip seal 17 (made from rubber) is interposed between the bottom 3 and the base. Here, it is a seal in the form of a bowl. It would of course be possible to use a base bearing a sealing lip integrated by overmolding, as described by patent FR2215603.

The igniter means 10 is also secured to the bottom 3 of the cartridge case.

Thus, the central ring 5 includes an annular bearing surface 11 on which a collar 12 of the igniter means 10 bears.

The igniter means 10 includes a groove 13 in which an elastic ring 14 is housed that ensures the translational connection of the igniter means 10 and the bottom 3. This elastic ring can be completed by a bearing washer so as to distribute the force on the central ring 5.

Furthermore, as shown more clearly in FIG. 3, the annular bearing surface 11 is delimited at the inner end of each arm 6 by a partially cylindrical zone 15 that is intended to cooperate with a flat 10*b* of the igniter means. These zones 15 are intended to form a rotational stop means for the igniter means 10. Of course, it suffices to have at least one zone 15 (and not one per arm) to form a rotational stop.

Furthermore, it would be possible not to position these zones at the end of the arm, but for example between two adjacent arms.

In order to secure the connection between the cartridge case 1 and the base 8, each connecting arm 6 has a connection profile that is reinforced both at the central ring 5 and the peripheral cup 4. As shown in FIG. 4, the thickness E of the cartridge case 1 is increased at the cup 4 (thickness E1) and the ring 5 (thickness E2).

As shown in FIG. 4 and FIGS. 1 and 2, each arm 6 also includes a radial slot 16 that reduces its thickness and that extends radially from the central ring 5 to the peripheral cup 4. These radial slots make it possible to facilitate the fragmentation of the arms 6 during firing. The combustion of the entire cartridge case 1 is thus facilitated, even at the zones of reinforced thickness E1 and E2.

According to a variant embodiment, in order to improve the mechanical strength of the cartridge case 1, it is possible to provide at least one structural reinforcing material at the bottom 4.

This reinforcing material may comprise synthetic or mineral fibers that will be distributed in the combustible material of the cartridge case 1 during the molding thereof.

According to another variant, the structural reinforcing material may comprise at least one perforated insert (not shown) such as a canvas or mesh that will be embedded in the combustible material of the cartridge case at the bottom 4 and/or arms 6 and/or the combustible central ring 5.

This last variant makes it possible to better control the location of the reinforcing materials.

The cartridge case 1 according to the invention therefore has no plastic cup or support tube at the connection of the base and the igniter means. Eliminating the support cup also makes it possible to eliminate rivets that, in the solution described by patent EP1092939, allowed the mechanical connection of the combustible cartridge case and the plastic cup. These rivets also formed firing residues.

The igniter means 10 remain secured to the solid base 8 and it is ejected with the latter after firing.

The pressure from the propellant gases associated with the possible presence of weakened areas (such as the radial slots 16) causes fragmentation of the bottom 3 of the cartridge case 1, which promotes its combustion.

The cartridge case 1 according to the invention thus makes it possible to avoid firing residues and therefore secures the operation of the ammunition.

The invention claimed is:

1. A combustible cartridge case for ammunition, the cartridge case comprising a cylindrical enclosure intended to contain a propellant charge and to receive a projectile at a forward end of the cylindrical enclosure, the cartridge case including, at a rear end of the cartridge case, a bottom made in a single piece with the cylindrical enclosure and which is intended to be positioned in a base, the bottom including a combustible central ring that is connected to a peripheral cup by at least two combustible radial arms delimiting openings, each connecting arm having a connection profile that is reinforced both at the central ring and at the peripheral cup, the reinforced connection profile being in the form of increased thickness.

2. The combustible cartridge case according to claim 1, wherein the central ring includes an annular bearing surface intended to receive an igniter means.

3. The combustible cartridge case according to claim 2, wherein the annular bearing surface is delimited by at least one partially cylindrical zone intended to cooperate with a flat of the igniter means and intended to form a rotational stop means for the igniter means.

4. The combustible cartridge case according to claim 1, wherein each arm includes a radial slot reducing a thickness of the respective arm, the radial slot extending from the central ring to the peripheral cup.

5. The combustible cartridge case according to claim 1, wherein the bottom includes at least one structural reinforcing material.

6. The combustible cartridge case according to claim 5, wherein the reinforcing material comprises synthetic or mineral fibers distributed in the combustible material of the cartridge case.

7. The combustible cartridge case according to claim 5, wherein the reinforcing material comprises at least one perforated insert, embedded in the combustible material of the cartridge case.

* * * * *